United States Patent [19]

Cook

[11] 4,080,905

[45] Mar. 28, 1978

[54] SCHNABEL RAILWAY CAR SKID SHIPPING ASSEMBLY

[75] Inventor: John P. Cook, Chattanooga, Tenn.

[73] Assignee: Combustion Engineering, Inc., Windsor, Conn.

[21] Appl. No.: 643,429

[22] Filed: Dec. 22, 1975

[51] Int. Cl.[2] ..... B61D 3/14; B61D 3/16; B65G 61/00; B66F 9/00

[52] U.S. Cl. ..... 105/367; 105/158 R; 214/318; 214/621

[58] Field of Search ..... 105/159, 367, 158 R; 214/38 CA, 312, 313, 314, 318, 621

[56] References Cited

U.S. PATENT DOCUMENTS

| | | | |
|---|---|---|---|
| 1,934,583 | 11/1933 | Becker | 214/38 CA |
| 2,674,371 | 4/1954 | Blackinton | 220/1.5 X |
| 3,532,061 | 10/1970 | Bohm | 105/159 |
| 3,744,434 | 7/1973 | Patrick | 150/367 |
| 3,837,295 | 9/1974 | Fedele | 105/367 |

FOREIGN PATENT DOCUMENTS

| | | | |
|---|---|---|---|
| 2,231,621 | 1/1974 | Germany | 105/367 |

*Primary Examiner*—Lawrence J. Oresky
*Assistant Examiner*—Howard Beltran
*Attorney, Agent, or Firm*—Wayne H. Lang

[57] ABSTRACT

A shipping and handling fixture for a large load such as a steam generator or a reactor vessel. The fixture includes an elongate skid that may be integrated with wheeled sections at opposite ends thereof to form a Schnabel-type railway car or over-the-road vehicle that supports the vessel during shipment and facilitates its handling. In addition, a unique rocker arm and lifting link at opposite ends thereof cooperate to provide an arrangement for upending the vessel to permit ease of installation and assembly after it has arrived at its destination.

6 Claims, 4 Drawing Figures

SCHNABEL RAILWAY CAR SKID SHIPPING ASSEMBLY

BACKGROUND OF THE INVENTION

1. Field of the Invention

This application relates to apparatus having independent wheeled sections that are connected to opposite ends of a load to permit shipment by what is known as a Schnabel-type vehicle. The apparatus includes a longitudinal carrier beam that facilitates shipment and storage together with a rocker assembly and lifting link whereby the load may be readily transported to its assembly site and then moved from a horizontal into a vertical position.

2. Description of Prior Art

In apparatus of the type herein defined, a load to be transported is connected at opposite ends thereof to each of the bottom sections of independent cars in the manner shown by U.S. Pat. No. 3,532,061 and 3,744,434. In these patents a heavy load is carried between wheeled railway cars whereby the load itself becomes an integral part of the vehicle that is subjected to massive tensile and compressive forces. Furthermore, the load is entirely unsupported during handling procedures or during shipment on an oceangoing barge so that it is subjected to constant bending forces. Moreover, "upending" and installation procedures are slowed significantly and made more difficult in the usual type apparatus by the absence of auxiliary handling structure.

SUMMARY OF THE INVENTION

The present invention is accordingly directed to a Schnabel-type vehicle having independent fore and aft wheeled sections with a skid therebetween that is adapted to support a given load during shipping. The skid is also adapted to include a longitudinal member having a lifting lug at one end and a rocker arm at the other end whereby vertical movement of the lifting lug will upend the entire apparatus upon the rocker arm in a manner that facilitates assembly.

BRIEF DESCRIPTION OF THE DRAWING

For a better understanding of the nature and objectives of my invention, reference may be had to the following detailed description taken in conjunction with the accompanying drawings in which.

DETAILED DESCRIPTION

Figure 1:
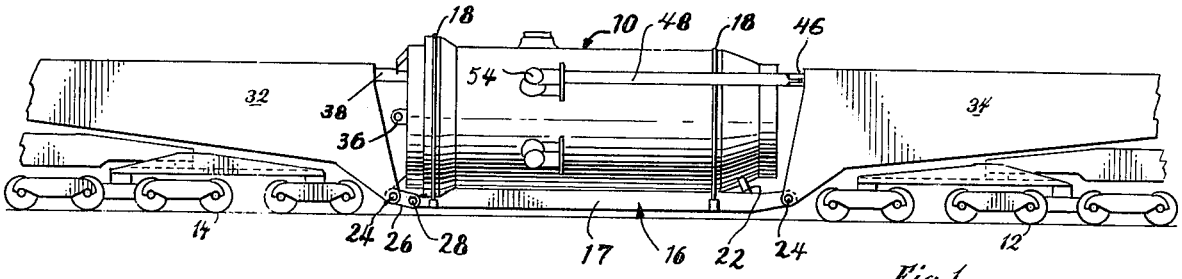
FIG. 1 is a side elevation of the divided car in accordance with the present invention.
Figure 2:
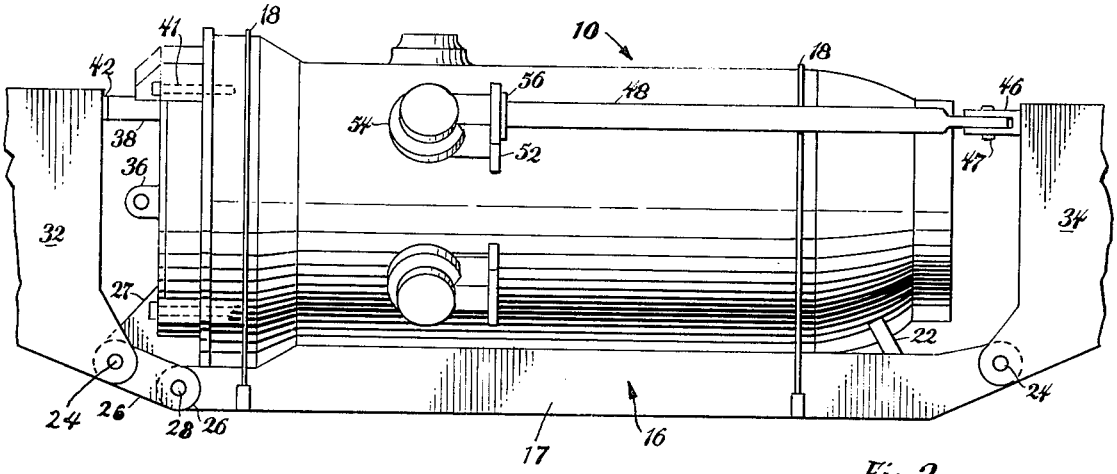
FIG. 2 is an enlarged side view of the same arrangement.
Figure 3:
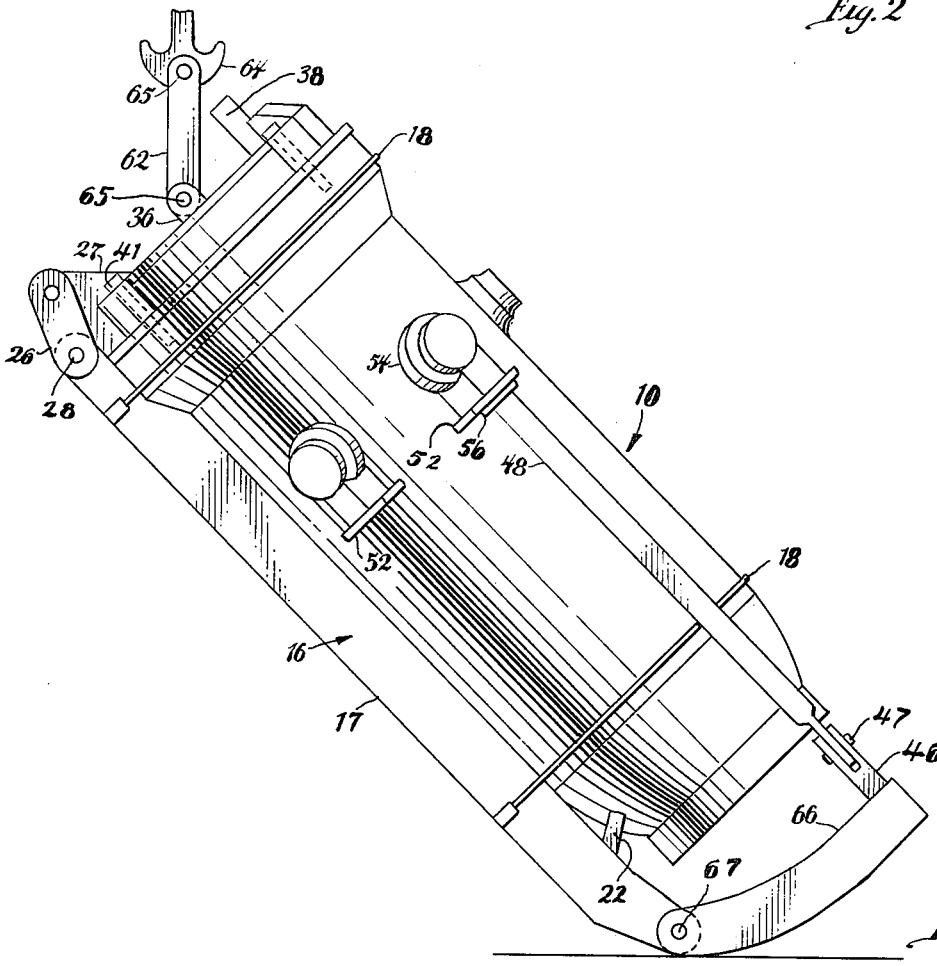
FIG. 3 is a side view of the rocker arm and lifting arrangement as being applied.
Figure 4:
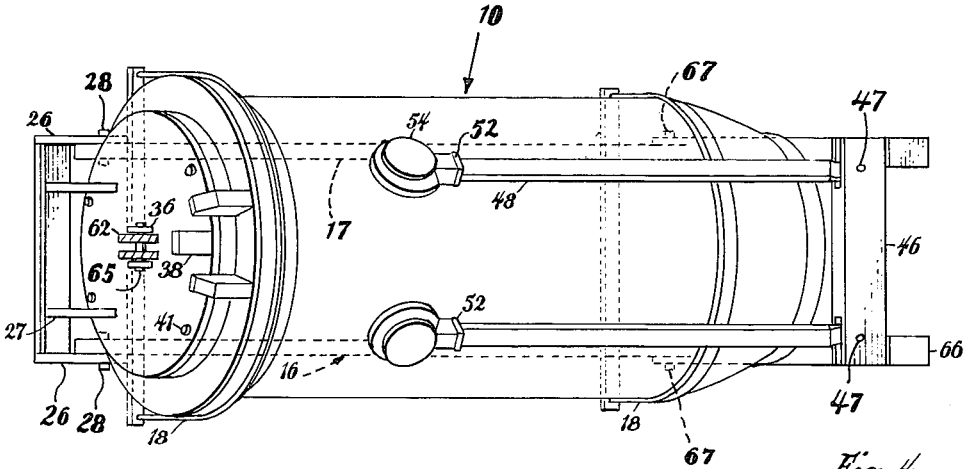
FIG. 4 is a plan view, partially inclined to show a cooperating relationship between the several parts.

Referring now more particularly to FIG. 1 of the drawing, there is shown a general side view of the present invention wherein a Schnabel-type car includes spaced apart wheeled sections that support an elongate load 10 therebetween. The wheeled sections generally comprise fore and aft sections 12–14 having intermediate removable skid means 16 that include spaced cable assemblies 18 for securing the elongate load to the skid. A cross member 22 is adjustable along the longitudinal axis of the skid to snugly abut the load and thus account for minor differences in length of various loads and thereby provide a continuous support.

The skid means 16 is pivotally attached to the fore and aft wheeled cars 12 and 14 by means of pins 24. The skid means 16 has link lugs 26 connected by pivot 28 to the load support 17 to connect by pivot pins 24 the skid means 16 to the respective wheeled cars 12 and 14 and permit movement about a horizontal axis.

A lifting beam 27 is pivotally attached by pins 24 to link lugs 26 to enable the lifting beam to extend across an end of the load and be fastened integrally thereto by means of a plurality of bolts 41. The bolts 41 engage matching openings on the load to enable the load to be simultaneously integral with the lifting beam 27 and with the skid 16 attached thereto. A lifting lug 36 is centrally positioned on the lifting beam 27 whereby it may be engaged with a suitable lifting hook to upend the load or otherwise facilitate handling. The upper port of each lifting beam 27 includes a short compression column 38 that is sized to engage the compression pad 42 on adjacent Schnabel Arm 32 whereby compressive force may be transmitted directly from the Schnabel Arm to the end of the vessel that comprises the load.

The lifting beam 27 is fastened securely to the end of the load by means of a plurality of bolts 41 making the load simultaneously integral with the lifting beam and the skid whereby there can be no relative movement therebetween.

At the other end of the load the Schnabel arm 34 abuts a cross beam 46 that is secured by bolts 47 to horizontal pipe columns 48 that in turn abut support pads 52 on lateral projections 54. Shims 56 as required between the base of column 48 and pad 52 adjust the length of the columns to accommodate minor differences in loads.

After arrival at the plant site where final installation of the unit is to be made, a link 62 is pivotally attached at one end to the lug 36 and at its opposite end to a crane hook 64 by pivot pins 65. The pivot pins 24 are also removed from the opposite ends of skid means 16 to separate the Schnabel arms 32 and 34 from skid means 16 and to provide pin means 67 for pivotally attaching a rocker assembly 66 having a cross-beam 46 for attachment to column 48. When link 62 is raised, the weight of the load upon the rocker arm 66 is adapted to bear directly against the compression columns 48 through intermediate beams 46 in the manner originally effected by the Schnabel arm 34 whereby the weight of the load is transmitted through the compression columns 48 to the projections 54 as long as the load rests on the rocker assembly 66.

Since equivalent shapes and arrangements may be used interchangeably for the above defined apparatus, it will be understood that this disclosure is illustrative only of a preferred means that embodies the invention. The invention will therefore be determined only by the scope of the appended claims.

I claim:

1. A shipping vehicle for an elongate load having a lateral projection intermediate ends thereof comprising separable wheeled sections at opposite ends of the load arranged to comprise a Schnabel-type car, an elongate load carrying skid between sections of the car, pivotal lugs at opposite ends of the skid for attachment to the spaced apart sections of the car, means pivotally attaching the lugs to adjacent sections of the Schnabel car, and a compression beam extending longitudinally intermediate the lateral projection on the load and a wheeled section of the car enabling compressive forces effected by the weight of the load on the skid to be transmitted horizontally from a section of the Schnabel car through the compression beam to the lateral projection on the load.

2. A shipping fixture for an elongate load as defined in claim 1 wherein the compression beam intermediate a wheeled car and a lateral projection on the load lies above the neutral axis of said load.

3. A shipping fixture for an elongate load as defined in claim 1 having means at opposite ends of the load that secure the load to the skid to produce an integral assembly.

4. A shipping fixture for an elongate load as defined in claim 1 further including a lifting beam, and means securing the lifting beam to an end of the load whereby lifting said beam will raise the adjacent end of the assembly when the load is disconnected from the wheeled sections.

5. A shipping fixture for an elongate load as defined in claim 1 further including means that simultaneously connects the lifting beam to one end of the support skid and to an end of the load.

6. A shipping fixture as defined in claim 5 further including a rocker assembly, having means connecting said rocker assembly to the lugs at the opposite end of said skid, and where the rocker assembly is adapted to continuously abut the compression beam whereby the weight of the load is applied against the lateral projection.

* * * * *